US007738004B2

(12) United States Patent
Park et al.

(10) Patent No.: US 7,738,004 B2
(45) Date of Patent: Jun. 15, 2010

(54) DISPLAY APPARATUS TO DISPLAY A PICTURE ACCORDING TO AN INPUT VIDEO SIGNAL AND CONTROL METHOD THEREOF

(75) Inventors: Dong-sik Park, Suwon-si (KR); Young-chan Kim, Euiwang-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 814 days.

(21) Appl. No.: 11/144,736

(22) Filed: Jun. 6, 2005

(65) Prior Publication Data

US 2006/0050178 A1 Mar. 9, 2006

(30) Foreign Application Priority Data

Aug. 30, 2004 (KR) ..... 10-2004-0068667

(51) Int. Cl.
*G09G 5/02* (2006.01)

(52) U.S. Cl. ..... 345/699; 345/3.3

(58) Field of Classification Search ..... 345/698–699, 345/3.2–3.4; 348/542, 555, 556
See application file for complete search history.

(56) References Cited

U.S. PATENT DOCUMENTS 6,504,533 B1 * 1/2003 Murayama et al. ..... 345/698
6,894,706 B1 5/2005 Ward et al.
7,068,293 B2 * 6/2006 Wang ..... 345/698
2002/0089525 A1 * 7/2002 Huang ..... 345/698
2003/0184532 A1 10/2003 Chen et al.
2003/0184572 A1 * 10/2003 Kaise ..... 345/698
2004/0183793 A1 * 9/2004 Akaiwa et al. ..... 345/698

FOREIGN PATENT DOCUMENTS

JP 11-282407 10/1999
JP 2000-010534 1/2000
JP 2003-295853 10/2003
KR 1020010010482 2/2001

OTHER PUBLICATIONS

Korean Office Action dated Feb. 28, 2006 of Korean Patent Application No. 10-2004-0068667.
PCT Search Report dated Dec. 5, 2005 issued in PCT/KR2005/2786.
European Search Report issued Nov. 3, 2008 EP 05775996.1.

* cited by examiner

*Primary Examiner*—Chanh Nguyen
*Assistant Examiner*—Allison Walthall
(74) *Attorney, Agent, or Firm*—Stanzione & Kim LLP

(57) ABSTRACT

A display apparatus displaying a picture based on an input video signal includes an auto-adjustment button to select an implement of an auto-adjustment function, and a controller to implement a quick auto-adjustment function when the input video signal is determined to be changed in a display mode on the basis of the input video signal, and to implement a detailed auto-adjustment function when the auto-adjustment function is selected by the auto-adjustment button. In the display apparatus and a control method thereof, the auto-adjustment function is differently implemented according to the auto-adjustment mode and the selection of the auto-adjustment button.

17 Claims, 3 Drawing Sheets

DISPLAY APPARATUS TO DISPLAY A PICTURE ACCORDING TO AN INPUT VIDEO SIGNAL AND CONTROL METHOD THEREOF

CROSS-REFERENCE TO RELATED APPLICATIONS

This application claims the benefit of Korean Patent Application No. 2004-68667, filed on Aug. 30, 2004, in the Korean Intellectual Property Office, the disclosure of which is incorporated herein by reference.

BACKGROUND OF THE INVENTION

1. Field of the Invention

The present general inventive concept relates to a display apparatus and a control method thereof, and more particularly, to a display apparatus and a control method thereof, in which an auto-adjustment function is differently implemented according to an auto-adjustment mode and selection of an auto-adjustment button.

2. Description of the Related Art

Generally, a display apparatus receives a video signal of a predetermined display mode from a video signal source, such as a computer, a television broadcasting system, etc., and displays a picture based on the video signal. Recently, in the display apparatus, a cathode ray tube (CRT) is replaced by a flat panel display, such as a liquid crystal display (LCD), a plasma display panel (PDP), etc.

As compared with a CRT display apparatus, a flat panel display apparatus receives an analog video signal from the video signal source, and converts the analog video signal into a digital video signal, thereby displaying a picture. Here, the flat panel display comprises an analog/digital (A/D) converter to convert the analog video signal into the digital video signal. Further, the digital video signal outputted from the A/D converter is processed by a preset signal processing procedure, and transmitted to the LCD panel or the PDP, thereby correspondingly driving a pixel provided on a screen to display the picture.

Meanwhile, the display apparatus has a function of automatically changing a display mode suitably when resolution of the analog video signal is varied, which is called an auto-adjustment function.

For example, the video signal outputted from the video signal source, such as a computer, has various resolution of 640×480 at 60 Hz, 640×480 at 75 Hz, 800×600 at 60 Hz, 1024×768 at 60 Hz, 1600×1200 at 60 Hz, 1920×1200 at 60 Hz, and so on. In a case where the display apparatus has a resolution of 1024×768 at 60 Hz, and the video signal having a resolution of 640×480 at 75 Hz is inputted from the video signal source, the video signal is not optimally displayed as a picture. Therefore, the auto-adjustment function compensates the preset display mode for the input video signal, thereby optimally displaying the picture on the screen.

Generally, the auto-adjustment function of the display apparatus is implemented only when an auto-adjustment button provided in a front of the display apparatus is operated.

Further, there is a display apparatus that continuously applies the auto-adjustment function to the video signal. In this case, the auto-adjustment function is implemented whenever a display mode of the video signal is changed. Here, the change of the display mode is determined on the basis of horizontal/vertical synchronization signals of the video signal.

However, it takes about 6~7 seconds until the auto-adjustment function is implemented in the display apparatus although there is a difference in the implementation time according to the display apparatuses or the input video signals. Also, while the auto-adjustment function is implemented, the picture displayed on the display apparatus is shaken or moves left and right.

At this time, a user is able to suppose that the picture displayed on the display apparatus will be shaken or moves left and right in the case where the auto-adjustment function is implemented according as he/she pushes the auto-adjustment button. However, in the case where the auto-adjustment function is implemented according as the display mode of the video signal is changed, a user cannot suppose that a picture displayed on the display apparatus will be shaken or moves left and right, so that he/she is likely to take that a picture displayed on the display apparatus is shaken or moves left and right for troubles with the video signal source or the display apparatus.

Further, when the auto-adjustment function is suddenly implemented while the display apparatus displays the picture, it may be inconvenient to use the display apparatus for 6~7 seconds because the picture displayed on the display apparatus is shaken or moves left and right.

SUMMARY OF THE INVENTION

The present general inventive concept provides a display apparatus and a control method thereof, in which an auto-adjustment function is differently implemented according to an auto-adjustment mode and selection of an auto-adjustment button.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a display apparatus displaying a picture based on an input video signal, the display apparatus comprising an auto-adjustment button to select an implement of an auto-adjustment function, and a controller to implement a quick auto-adjustment function when the input video signal is determined to be changed in a display mode on the basis of the input video signal, and to implement a detailed auto-adjustment function when the implementation of the auto-adjustment function is selected by the auto-adjustment button.

The display apparatus may further comprise a mode setting part to set an auto-adjustment mode, and the controller implements the quick auto-adjustment function when the input video signal is determined to be changed in the display mode in a state that the auto-adjustment mode is set by the mode setting part.

The foregoing and/or other aspects and advantages of the present general inventive concept may also be achieved by providing a method of controlling a display apparatus displaying a picture based on an input video signal, the method comprising detecting whether the input video signal is changed in a display mode on the basis of the input video signal, implementing a quick auto-adjustment function when the input video signal is changed in the display mode, selecting an implement of a detailed auto-adjustment function by operating an auto-adjustment button provided in the display apparatus, and implementing the detailed auto-adjustment according to the selection of the auto-adjustment button.

The method may further comprise setting an auto-adjustment mode, so that the quick auto-adjustment function is implemented when the input video signal is changed in the display mode in a state that the auto-adjustment mode is set.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
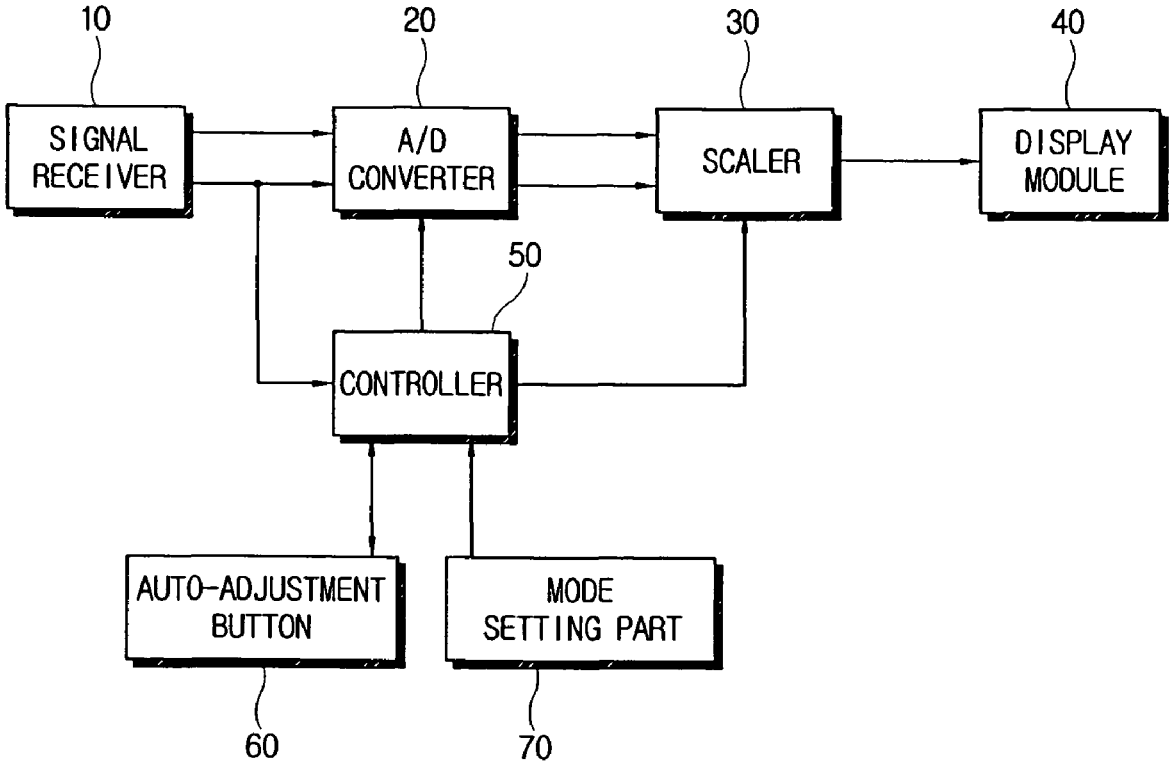
FIG. 1 is a control block diagram of a display apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

As shown in FIG. 1, a display apparatus according to an embodiment of the present general inventive concept comprises a signal receiver 10, an A/D converter 20, a scaler 30, a display module 40, an auto-adjustment button 60, a mode setting part 70, and a controller 50.

The signal receiver 10 receives an analog video signal from a video signal source such as a computer, a television broadcasting system or the like. Here, the analog video signal contains analog video data, a horizontal synchronization signal, and a vertical synchronization signal.

The signal receiver 10 may comprise various connectors to receive a video signal of various formats. For example, the signal receiver 10 comprises at least one of a D-Sub connector to receive the analog video signal, a composite video broadcast signal (CVBS) connector, an S-video connector, and a component connector.

The A/D converter 20 converts the analog video signal inputted through the signal receiver 10 into a digital video signal. The digital video signal outputted from the A/D converter 20 is scaled by the scaler 30 and then transmitted to the display module 40.

The display module 40 displays a picture on a screen according to the digital video signal outputted from the scaler 30. The display module 40 may include various modules, such as an LCD module, a PDP module or the like, as long as it can display the picture according to the digital video signal outputted from the scaler 30.

The auto-adjustment button 60 may be provided in a front of the display apparatus. When a user pushes the auto-adjustment button 60, the controller 50 implements a detailed auto-adjustment function.

The mode setting part 70 may be employed for allowing a user to set an auto-adjustment mode. The mode setting part 70 can be provided as a button placed on a front of the display apparatus or on a remote controller.

The controller 50 continuously checks whether to implement a quick auto-adjustment function for the input video signal in a case where the auto-adjustment mode is set by a user through the mode setting part 70. Here, the controller 50 checks whether a display mode of the input video signal is changed or not according to changes in horizontal/vertical synchronous signals, and implements the quick auto-adjustment function when the display mode of the input video signal is changed.

Further, the controller 50 senses whether the auto-adjustment button 60 is pushed by the user, and implements the detailed auto-adjustment function when the user pushes the auto-adjustment button 60.

According to an embodiment of the present invention, the controller 50 implements the auto-adjustment function with regard to a plurality of auto-adjustment items. The plurality of auto-adjustment items includes at least one of a position adjustment, a size adjustment, a coarse (or frequency) adjustment, and a fine adjustment.

Here, the controller 50 detects a setting value about a position and a size of the picture according to a back porch value of the input video signal. Further, the controller 50 detects the setting value about the coarse adjustment according to an H-Total value (a total number of horizontal pixels for horizontal resolution) of the input video signal. Also, the controller 50 detects the setting value about the fine adjustment according to a sum of differences between neighboring gradation data of the input video signal. Herein, a method of detecting the setting value about each auto-adjustment item is well known and thus will be omitted.

Meanwhile, the quick auto-adjustment function and the detailed auto-adjustment function, which are implemented by the controller 50, may be equal in detecting the setting value by the foregoing method, but different as follows.

As an example of the coarse adjustment, suppose that the display apparatus has a resolution of 1024×768 at 85 Hz, and the H-Total value of 1376 pixels. In this case, when the detailed auto-adjustment function is implemented, the controller 50 increases or decreases the H-Total value of 1376 pixels by 1. On the other hand, when the quick auto-adjustment function is implemented, the controller 50 increases or decreases the H-Total value of 1376 pixels by N, e.g., 4. Hence, the quick auto-adjustment function is deteriorated in detail but is quickly implemented as compared with the detailed auto-adjustment function.

Like the coarse adjustment, in a case of the fine adjustment, when the detailed auto-adjustment function is implemented, the controller 50 calculates the sum of the differences between directly neighboring gradation data of the input video signal. On the other hand, when the quick auto-adjustment function is implemented, the controller 50 calculates the sum of the differences between the gradation data, for example, four gradation intervals, thereby reducing a running time of the auto-adjustment mode.

Figure 2:
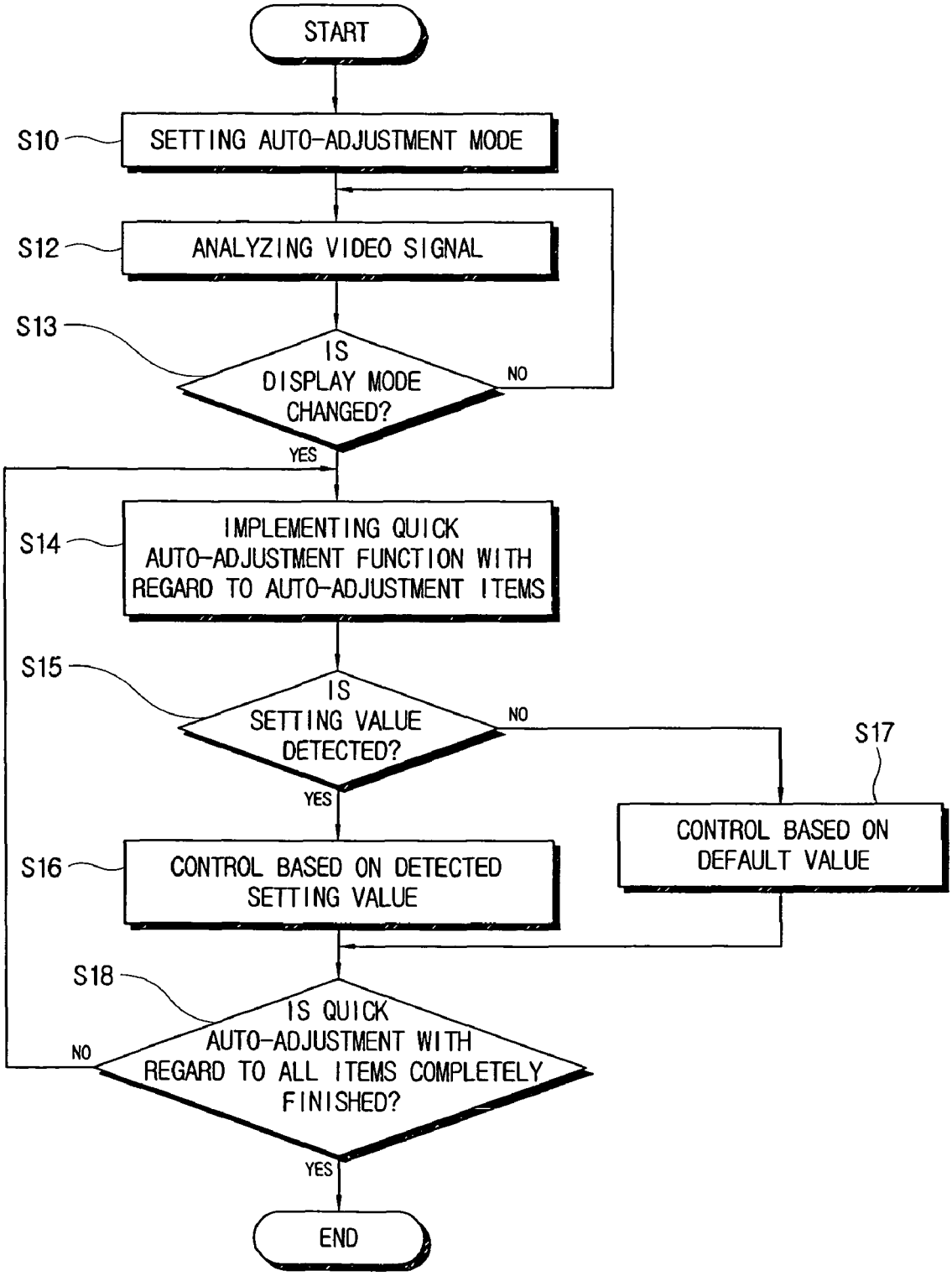
FIGS. 2 and 3 are flowcharts of a method of controlling a display apparatus according to an embodiment of the present general inventive concept.

Hereinbelow, a process of implementing a quick auto-adjustment function of a display apparatus according to an embodiment of the present general inventive concept will be described with reference to FIGS. 1 and 2.

At operation S10, a user sets the auto-adjustment mode through the mode setting part 70. At operation S12, the controller 50 continuously analyzes the video signal inputted through the signal receiver 10. At operation S13, the controller 50 checks whether the display mode of the input video signal is changed.

When the display mode of the video signal is changed, at operation S14, the controller 50 implements the quick auto-adjustment function with respect to each auto-adjustment item. At operation S15, the controller 50 detects the setting value about the corresponding auto-adjustment item. At operation S16, the controller 50 controls the A/D converter 20, the scaler 30, and/or the display module 40 according to the detected setting value. On the other hand, when the setting value about the corresponding auto-adjustment item is not detected, at operation S17, the controller 50 controls the A/D converter 20, the scaler 30, and/or the display module 40 according to a default value of the corresponding auto-adjustment item.

At operation S18, the controller 50 checks whether the quick auto-adjustment function is completely implemented with regard to all auto-adjustment items. When the quick auto-adjustment function is completely implemented with regard to all auto-adjustment items, the quick auto-adjustment function is finished.

Figure 3:
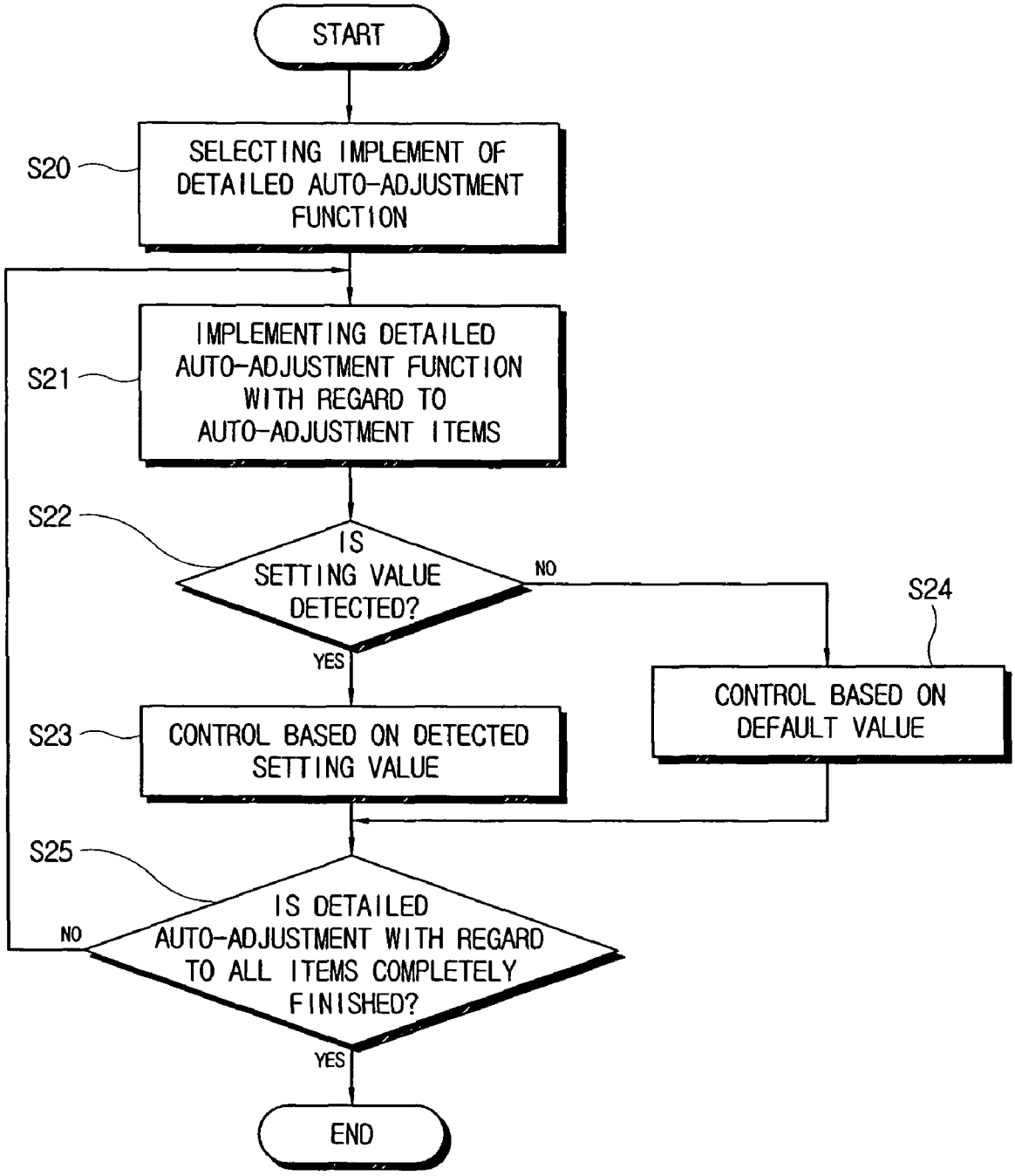

Hereinbelow, a process of implementing a detailed auto-adjustment function of a display apparatus according to an embodiment of the present general inventive concept will be described with reference to FIGS. 1 and 3.

At operation S20, a user pushes the auto-adjustment button 60 to implement the detailed auto-adjustment function. At operation S21, the controller 50 implements the detailed auto-adjustment function with regard to every auto-adjustment items. At operation S22, the controller 50 detects the setting value about the corresponding auto-adjustment item. At operation S23, the controller 50 controls a signal processor including the A/D converter 20, the scaler 30, and/or the display module 40 according to the detected setting value. On the other hand, when the setting value about the corresponding auto-adjustment item is not detected, at operation S24, the controller 50 controls the signal processor including the A/D converter 20, the scaler 30, and/or the display module 40 according to the default value of the corresponding auto-adjustment item. At operation S25, the controller 50 checks whether the detailed auto-adjustment function is completely implemented with regard to all auto-adjustment items. When the detailed auto-adjustment function is completely implemented with regard to all auto-adjustment items, the detailed auto-adjustment function is finished.

Thus, the display apparatus may comprise the auto adjustment button to select the implement of the auto-adjustment function, and the controller 50 to implement the quick auto-adjustment function when it is determined that the display mode of the video signal is changed according to the video signal, and to implement the detailed auto-adjustment function when the auto-adjustment function is selected through the auto-adjustment button 60. Therefore, the quick auto-adjustment function is implemented at the auto-adjustment mode, thereby reducing the running time of the auto-adjustment function. Further, the detailed auto-adjustment function is implemented through the auto-adjustment button 60 as necessary, thereby optimizing a displaying state of the picture.

As described above, the present general inventive concept provides a display apparatus and a control method thereof, in which an auto-adjustment function is differently implemented according to an auto-adjustment mode and the selection of an auto-adjustment button, so that the running time of the auto-adjustment function is decreased, and a detailed auto adjustment function is implemented as necessary to obtain an optimum displaying state of the picture displayed on the screen.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A display apparatus to display a picture according to an input video signal, comprising:

an auto-adjustment button to select an auto-adjustment function; and a controller to implement a quick auto-adjustment function when the input video signal is determined to be changed in a display mode, where a resolution of the display mode is changed according to the input video signal, and to implement a detailed auto-adjustment function when the auto-adjustment function is selected by the auto-adjustment button, the quick auto-adjustment function having a shorter running time than the detailed auto-adjustment function, wherein the controller compensates a preset setting value that includes a total number of horizontal pixels for horizontal resolution of the display mode by adding or subtracting a predetermined additional value to or from the total number of horizontal pixels of the preset setting value to increase or decrease a time implementing the auto-adjustment function, and the quick auto-adjustment function having the larger additional value than the detailed auto-adjustment function.

2. The display apparatus according to claim 1, further comprising:

a mode setting part to set an auto-adjustment mode, wherein the controller implements the quick auto-adjustment function when the input video signal is determined to be changed in the display mode in a state that the auto-adjustment mode is set in the mode setting part.

3. A display apparatus to display a picture on a screen according to an input video signal, comprising:

an auto-adjustment button to set an auto-adjustment function;

a mode setting part to set an auto-adjustment mode; and a controller to selectively implement one of a detailed auto-adjustment function and a quick auto-adjustment function with respect to a changed input video signal according to the auto-adjustment function and the auto-adjustment mode set in the auto-adjustment button and the mode setting part, respectively, wherein the controller detects a change in a display mode where a resolution of the display mode is changed according to an input video signal, and implements the quick auto-adjustment function when the change in the display mode is detected, the quick auto-adjustment function having a shorter running time than the detailed auto-adjustment function, and the controller compensates a preset setting value that includes a total number of horizontal pixels for horizontal resolution of the display mode by adding or subtracting a predetermined additional value to or from the total number of horizontal pixels of the preset setting value to increase or decrease a time implementing the auto-adjustment function, and the quick auto-adjustment function having the larger additional value than the detailed auto-adjustment function.

4. The display apparatus according to claim 3, further comprising:

a signal receiver to receive the input video signal, a signal processor to process the input video signal to generate a signal corresponding to a picture to be displayed, wherein the controller controls the signal processor to process the input video signal according to the one of the quick auto-adjustment function and the detailed auto-adjustment function.

5. The display apparatus according to claim 3, wherein the controller adjusts a setting value of an auto-adjustment item with respect to the input video signal according to the one of the detailed auto-adjustment function and the quick auto-adjustment function.

6. The display apparatus according to claim 5, wherein the auto-adjustment item comprises at least one of a position adjustment, a size adjustment, a coarse adjustment, a frequency adjustment, and a fine adjustment.

7. The display apparatus according to claim 3, wherein the controller implements the detailed auto-adjustment function to adjust a setting value of an auto-adjustment item by a first number, and implements the quick auto-adjustment function to adjust the setting the auto-adjustment item by a second number larger that the first number.

8. The display apparatus according to claim 3, wherein the controller implements the detailed auto-adjustment function to calculate a sum of differences between a first number of neighboring gradation data of the input video signal, and implements the quick auto-adjustment function to calculate a sum of differences between a second number of gradation data less than the first number.

9. The display apparatus according to claim 3, wherein the controller detects a setting value of an auto-adjustment item of an input video signal, implements the quick auto-adjustment function to process the input video signal according to the detected setting value and to process the input video signal according to a default value when the setting value is not detected.

10. The display apparatus according to claim 3, wherein the controller detects a setting value of an auto-adjustment item of an input video signal, and implements the detailed auto-adjustment function to process the input video signal according to the detected setting value, and to process the input video signal according to a default value when the setting value is not detected.

11. A method of controlling a display apparatus to display a picture according to an input video signal, the method comprising:

detecting whether the input video signal is changed in a display mode, where a resolution of the display mode is changed according to the input video signal;

implementing a quick auto-adjustment function when the input video signal is changed in the display mode;

selecting an auto-adjustment function by operating an auto-adjustment button provided in the display apparatus;

implementing a detailed auto-adjustment function according to the selection of the auto-adjustment function of the auto-adjustment button, the quick auto-adjustment function having a shorter running time than the detailed auto-adjustment function; and compensating a preset setting value of the display mode that includes a total number of horizontal pixels for horizontal resolution by adding or subtracting a predetermined additional value to or from the total number of horizontal pixels of the preset setting value to increase or decrease a time implementing the auto-adjustment function, and the quick auto-adjustment function having the larger additional value than the detailed auto-adjustment function.

12. The method according to claim 11, further comprising:

setting an auto-adjustment mode, wherein the quick auto-adjustment function is implemented when the input video signal is changed in the display mode in a state that the auto-adjustment mode is set.

13. A method of controlling a display apparatus to display a picture according to an input video signal, the method comprising:

setting an auto-adjustment function;

setting an auto-adjustment mode;

selectively implementing one of a detailed auto-adjustment function and a quick auto-adjustment function according to the set auto-adjustment function and the set auto-adjustment mode, respectively, with respect to a changed input video signal; and detecting a change in a display mode where a resolution of the display mode is changed according to the input video signal, wherein the quick auto-adjustment function is implemented according to the detected change of the display mode, the quick auto-adjustment function having a shorter running time than the detailed auto-adjustment function; and compensating a preset setting value of the display mode that includes a total number of horizontal pixels for horizontal resolution adding or subtracting a predetermined additional value to or from the total number of horizontal pixels of the preset setting value to increase or decrease a time implementing the auto-adjustment function, and the quick auto-adjustment function having the larger additional value than the detailed auto-adjustment function.

14. The method according to claim 13, wherein the selectively implementing of the detailed auto-adjustment function and the quick auto-adjustment function comprises:

implementing the quick auto-adjustment function in a first running time.

15. The method according to claim 13, wherein the selectively implementing of the detailed auto-adjustment function and the quick auto-adjustment function comprises:

adjusting a setting value of an auto-adjustment item with respect to the input video signal according to the one of the detailed auto-adjustment function and the quick auto-adjustment function.

16. The method according to claim 13, wherein the selectively implementing of the detailed auto-adjustment function and the quick auto-adjustment function comprises:

processing the input video signal according to one of a setting value and a default value and the one of the detailed auto-adjustment function and the quick auto-adjustment function.

17. A method of controlling a display apparatus to display a picture, the method comprising:

receiving an input video signal;

detecting whether the input video signal is changed in a display mode, where a resolution of the display mode is changed according to the received input video signal;

implementing an auto-adjustment function on the received video signal when the received input video signal is detected to be changed in the display mode, and according to an auto-adjustment mode and a selection of an auto-adjustment button, the auto-adjustment function having a shorter running time than a detailed auto-adjustment function; and compensating a preset setting value of the display mode that includes a total number of horizontal pixels for horizontal resolution by adding or subtracting a predetermined additional value to or from the total number of horizontal pixels of the preset setting value to increase or decrease a time implementing the auto-adjustment function, and the quick auto-adjustment function having the larger additional value than the detailed auto-adjustment function.

* * * * *